US011181937B2

(12) United States Patent
Tomonaga et al.

(10) Patent No.: US 11,181,937 B2
(45) Date of Patent: Nov. 23, 2021

(54) CORRECTION CURRENT OUTPUT CIRCUIT AND REFERENCE VOLTAGE CIRCUIT WITH CORRECTION FUNCTION

(71) Applicant: DENSO CORPORATION, Kariya (JP)

(72) Inventors: Yukihiro Tomonaga, Kariya (JP); Kazutaka Honda, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 16/922,161

(22) Filed: Jul. 7, 2020

(65) Prior Publication Data

US 2020/0333821 A1 Oct. 22, 2020

Related U.S. Application Data

(63) Continuation of application No. PCT/JP2018/044232, filed on Nov. 30, 2018.

(30) Foreign Application Priority Data

Feb. 2, 2018 (JP) ..... JP2018-017264

(51) Int. Cl.

| | |
|---|---|
| ***G05F 3/30*** | (2006.01) |
| ***G05F 1/46*** | (2006.01) |
| ***G05F 1/567*** | (2006.01) |
| ***G05F 3/26*** | (2006.01) |

(52) U.S. Cl.

CPC ..... *G05F 3/30* (2013.01); *G05F 1/468* (2013.01); *G05F 1/567* (2013.01); *G05F 3/267* (2013.01)

(58) Field of Classification Search

CPC ..... G05F 3/04; G05F 3/26; G05F 3/30; G05F 3/267; G05F 1/468; G05F 1/567; H02M 1/00; H02M 1/0058

USPC ..... 323/313, 316, 281

See application file for complete search history.

(56) References Cited

U.S. PATENT DOCUMENTS

| | | | | |
|---|---|---|---|---|
| 5,767,664 | A * | 6/1998 | Price | G05F 3/30 323/313 |
| 5,801,271 | A | 9/1998 | Seido et al. | |
| 7,420,359 | B1 * | 9/2008 | Anderson | G05F 3/30 323/281 |
| 2013/0033305 | A1 * | 2/2013 | Fukazawa | G05F 1/567 327/539 |
| 2014/0084989 | A1 * | 3/2014 | Fujime | G05F 1/575 327/513 |
| 2019/0146011 | A1 * | 5/2019 | Honda | H03F 3/45475 324/123 R |

* cited by examiner

*Primary Examiner* — Yemane Mehari

(74) *Attorney, Agent, or Firm* — Posz Law Group, PLC

(57) ABSTRACT

A correction current output circuit comprises a first voltage dividing circuit for generating a voltage in which an output voltage from a bandgap reference voltage circuit is divided in multiple stages, first and second correction circuits connected between a power supply and a ground, and a second voltage dividing circuit for dividing the above voltage in multiple stages in a path in which a positive temperature characteristic voltage is generated with the band gap reference voltage circuit. Current output terminals of a the second transistor of the first correction circuit and a first transistor of the second correction circuit are connected to a common connection point, and a current for correcting the temperature characteristic of a reference voltage generation circuit is output from the common connection point.

13 Claims, 10 Drawing Sheets

CORRECTION CURRENT OUTPUT CIRCUIT AND REFERENCE VOLTAGE CIRCUIT WITH CORRECTION FUNCTION

CROSS REFERENCE TO RELATED APPLICATIONS

The present application is a continuation application of International Patent Application No. PCT/JP2018/044232 filed on Nov. 30, 2018, which designated the U.S. and claims the benefit of priority of Japanese Patent Application No. 2018-017264 filed on Feb. 2, 2018. The entire disclosures of both applications are incorporated herein by reference.

FIELD

The present disclosure relates to a circuit that generates and outputs a current that corrects a temperature characteristic of a reference voltage circuit.

BACKGROUND

An output voltage of a bandgap reference voltage circuit generally has a positive temperature characteristic. Various proposals are made conventionally for correcting the temperature characteristic. For example, two differential pairs are used to correct the temperature characteristic.

However, since the temperature characteristic is non-linear, it is difficult to estimate the non-linearity in advance. It is thus impossible in many instances to accurately correct a trial circuit actually manufactured. In the conventional proposal, a voltage of a same level having a positive temperature characteristic is applied to one gate of transistors forming two differential pairs.

SUMMARY

According to the present disclosure, a correction current output circuit comprises a bandgap reference voltage circuit, a first voltage dividing circuit, a first correction circuit, a second correction circuit and a second voltage dividing circuit. The first voltage dividing circuit generates divided voltage by dividing an output voltage of the bandgap reference voltage circuit in multiple stages. The first correction circuit is connected between a power supply and a ground and formed of a series circuit of a first current source and a first differential pair. The second correction circuit is connected between the power supply and the ground and formed of a series circuit of a second current source and a second differential pair. The second voltage dividing circuit is provided in a path, which generates a positive temperature characteristic voltage having a positive temperature characteristic, for dividing the positive temperature characteristic voltage in multiple stages.

Further, according to the present disclosure, a reference voltage circuit having a correction function is provided with the correction current output circuit.

BRIEF DESCRIPTION OF THE DRAWINGS

The present disclosure will become more apparent from the following detailed description with reference to the attached drawings. In the drawings.

DETAILED DESCRIPTION OF THE EMBODIMENT

Figure 1:
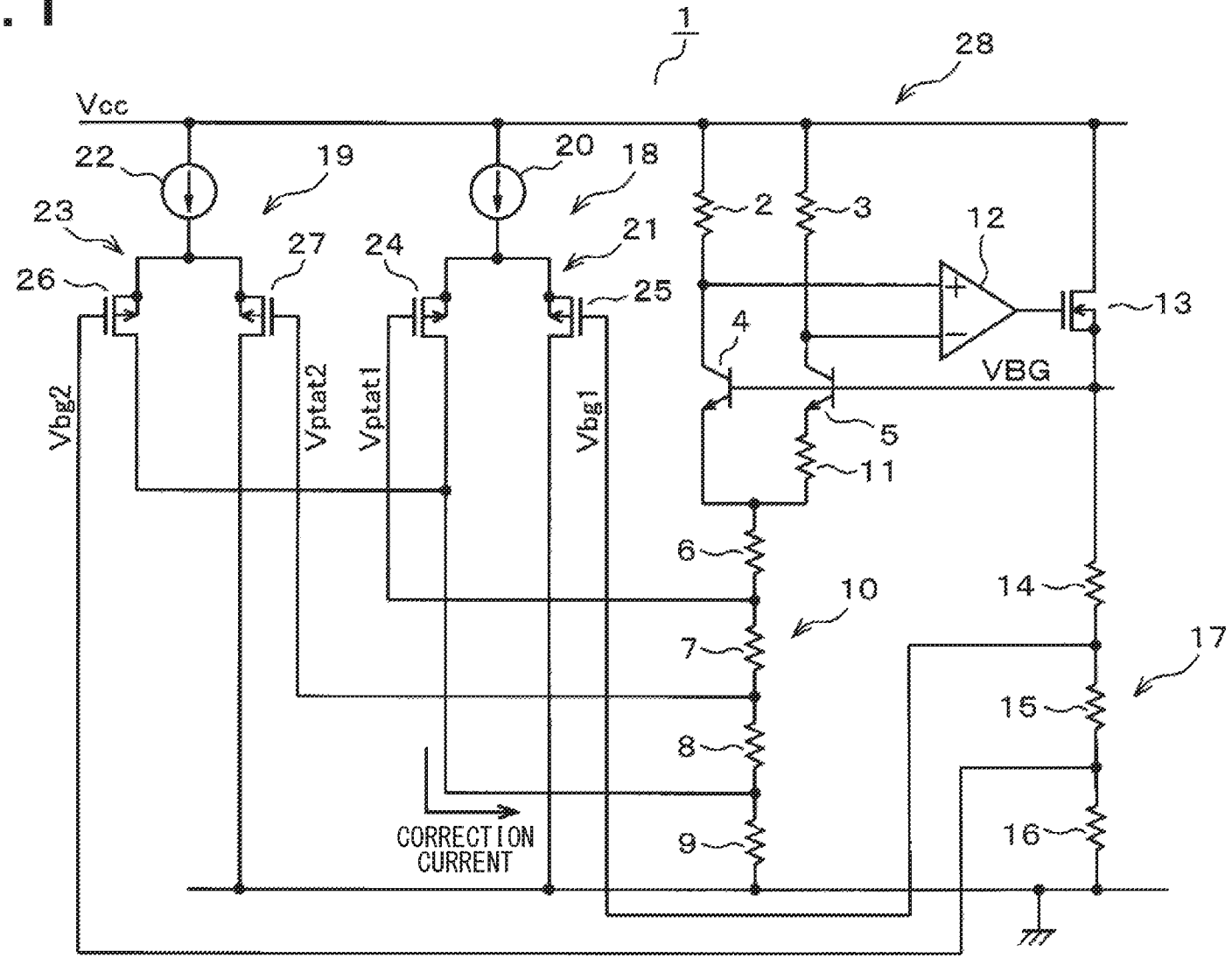
FIG. 1 is a circuit diagram showing a configuration of a reference voltage circuit according to a first embodiment.

In the following description, same configurations among embodiments described below will be designated by the same reference numerals for simplification of the description. Only differences among the embodiments will be described.

First Embodiment

As shown in FIG. 1, a reference voltage circuit 1 according to a first embodiment has a basic configuration of a Brouko cell type. One ends of resistance elements 2 and 3 are connected to a power supply Vcc, and the other ends of the same are connected to collectors of NPN transistors 4 and 5, respectively. An emitter of the transistor 4 is directly connected to a high potential side end (high-side end) of a second voltage dividing circuit 10 which is formed of four resistance elements 6 to 9 connected in series. An emitter of the transistor 5 is also connected to the high-side end of the second voltage dividing circuit 10 through an emitter resistor 11. A low potential side end of the second voltage dividing circuit 10 is connected to the ground.

The collectors of the transistors 4 and 5 are connected to a non-inverting input terminal and an inverting input terminal of an operational amplifier 12, respectively. A series circuit of an N-channel MOSFET 13 and a first voltage dividing circuit 17 formed of three resistance elements 14 to 16 connected in series is connected between the power supply Vcc and the ground. An output terminal of the operational amplifier 12 is connected to a gate of the FET 13.

A first correction circuit 18 and a second correction circuit 19 are connected between the power supply Vcc and the ground. The first correction circuit 18 is formed of a first series circuit of a first current source 20 and a first differential pair 21. The second correction circuit 19 is formed of a second series circuit of a second current source 22 and a second differential pair 23. The first differential pair 21 is formed of P-channel MOSFETs 24 and 25 whose sources are connected to a common connection point, that is, the first current source 18. The second differential pair 23 is similarly formed of P-channel MOSFETs 26 and 27 whose sources are connected to a common connection point, that is, the second current source.

A gate of the FET 24 is connected to a common connection point of the resistance elements 6 and 7. A gate of the FET 27 is connected to a common connection point of the resistance elements 7 and 8. A gate of the FET 25 is connected to a common connection point of the resistance elements 14 and 15. A gate of the FET 26 is connected to a common connection point of the resistance elements 15 and 16. Drains of the FETs 25 and 27 are connected to the ground. Drain of the FET 24 and the FET 26 are connected to a common connection point of the resistance elements 8 and 9. The FETs 25 and 26 are provided as first transistors. The FETs 24 and 27 are provided as second transistors.

In the above configuration of the reference voltage circuit 1, a circuit formed of circuit components 2 to 13, which are other than the first voltage dividing circuit 17, the first correction circuit 18 and the second correction circuit 19, is a bandgap reference voltage circuit 28. The second voltage dividing circuit 10 is arranged in a path, which generates a positive temperature characteristic voltage having a positive temperature characteristic in the band gap reference voltage circuit 28. The reference voltage circuit 1 is thus provided with a correction function.

Next, an operation of the present embodiment will be described. Gate potentials of the FETs 24 and 25 are indicated as Vptat1 and Vbg1, respectively. Gate potentials of the FETs 27 and 26 are indicated as Vptat2 and Vbg2, respectively. It is noted here that a suffix "ptat" is an abbreviation for "proportional to absolute temperature." In the configuration of the prior art technique, gate potentials of the FETs 24 and 27 are common. In the configuration of the present embodiment, the gate potentials of the FETs 24 and 27 are different potentials Vptat1 and Vptat2, respectively.

Figure 2:
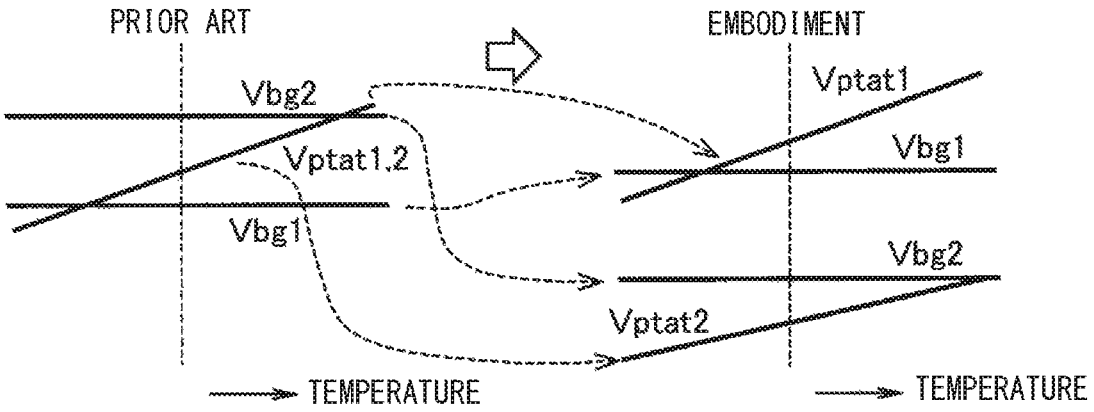
FIG. 2 is an explanatory diagram showing a voltage applied to a gate of each FET forming a correction circuit in a prior art and a present embodiment.

As shown in FIG. 2, in case the potentials Vptat1 and Vptat2 are common as in the prior art configuration, the positive temperature characteristics are equal. On the other hand, in the configuration of the present embodiment, since the potentials Vptat1 and Vptat2 are different, the temperature characteristics of the potentials are slightly different as shown in FIG. 2. From the drains of the FETs 24 and 26, a current for correcting the temperature characteristic of the output voltage VBG of the reference voltage circuit 1 is supplied to the common connection point of the resistance elements 8 and 9.

Figure 3:
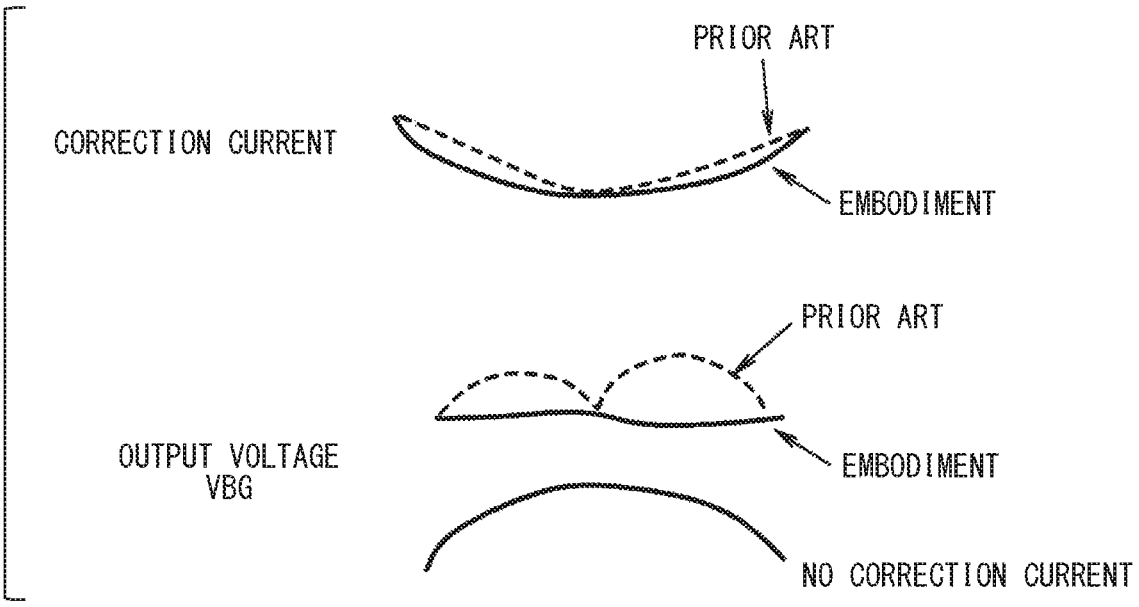
FIG. 3 is an explanatory diagram showing a correction of a temperature characteristic of an output voltage VBG by a correction current.

As shown in FIG. 3, the output voltage VBG has a temperature characteristic of an upwardly convex curve in case that no correction is performed. The current for correcting this characteristic is uniquely determined in the prior art configuration. In the present embodiment, as shown in FIG. 2, each potential Vptat1, Vptat2, Vbg1 and Vbg2 can be easily changed by trimming or wiring modification. Therefore, a nonlinear temperature characteristic of the correction current can be adjusted. That is, an optimum correction current can be easily generated.

As described above, according to the present embodiment, the reference voltage circuit 1 includes the first voltage dividing circuit 17 that generates a voltage by dividing the output voltage of the bandgap reference voltage circuit 28 in multiple stages, the first and second correction circuits 18 and 19 connected between the power supply Vcc and the ground, and the second voltage dividing circuit 10 that divides the voltage in multiple stages in a path that generates the positive temperature characteristic voltage in the bandgap reference voltage circuit 28.

The emitter of the transistor 4 is directly connected to a high-side end of the second voltage dividing circuit 10. The emitter of the transistor 5 is connected to the same high-side end via the emitter resistor 11. A bandgap voltage generated by feeding back a voltage corresponding to the potential difference between the collectors of the transistors 4 and 5 is applied to bases of the transistors 4 and 5.

The gate of the FET 25 forming the first differential pair 21 is connected to the common connection point of the resistance elements 14 and 15 of the first voltage dividing circuit 17. The gate of the FET 26 forming the second differential pair 23 is connected to the common connection point of the resistance elements 15 and 16. The gate of the FET 27 forming the second differential pair 27 is connected to the common connection point of the resistance elements 7 and 8 of the second voltage dividing circuit 10. The gate of the FET 24 forming the first differential pair 21 is connected to the common connection point of the resistance elements 6 and 7. The drains of the FETs 24 and 26 are commonly connected to the common connection point of the resistance elements 8 and 9 to output the current for correcting the temperature characteristic of the bandgap reference voltage generation circuit 28.

That is, unlike the prior art configuration, different potentials are applied to the gates of the FETs 24 and 27 in the second voltage dividing circuit 10. As a result, the currents output from the drains of the FETs 24 and 26 have different temperature characteristics corresponding to different potentials. Therefore, from the commonly connected drains, the current for correcting the temperature characteristic of the bandgap reference voltage generation circuit 28 is output as a combination of the different temperature characteristics described above. As a result, in case the temperature characteristic of the bandgap reference voltage generation circuit 28 is corrected, the degree of freedom of adjustment can be increased as compared with the conventional circuit.

Second Embodiment

Figure 4:
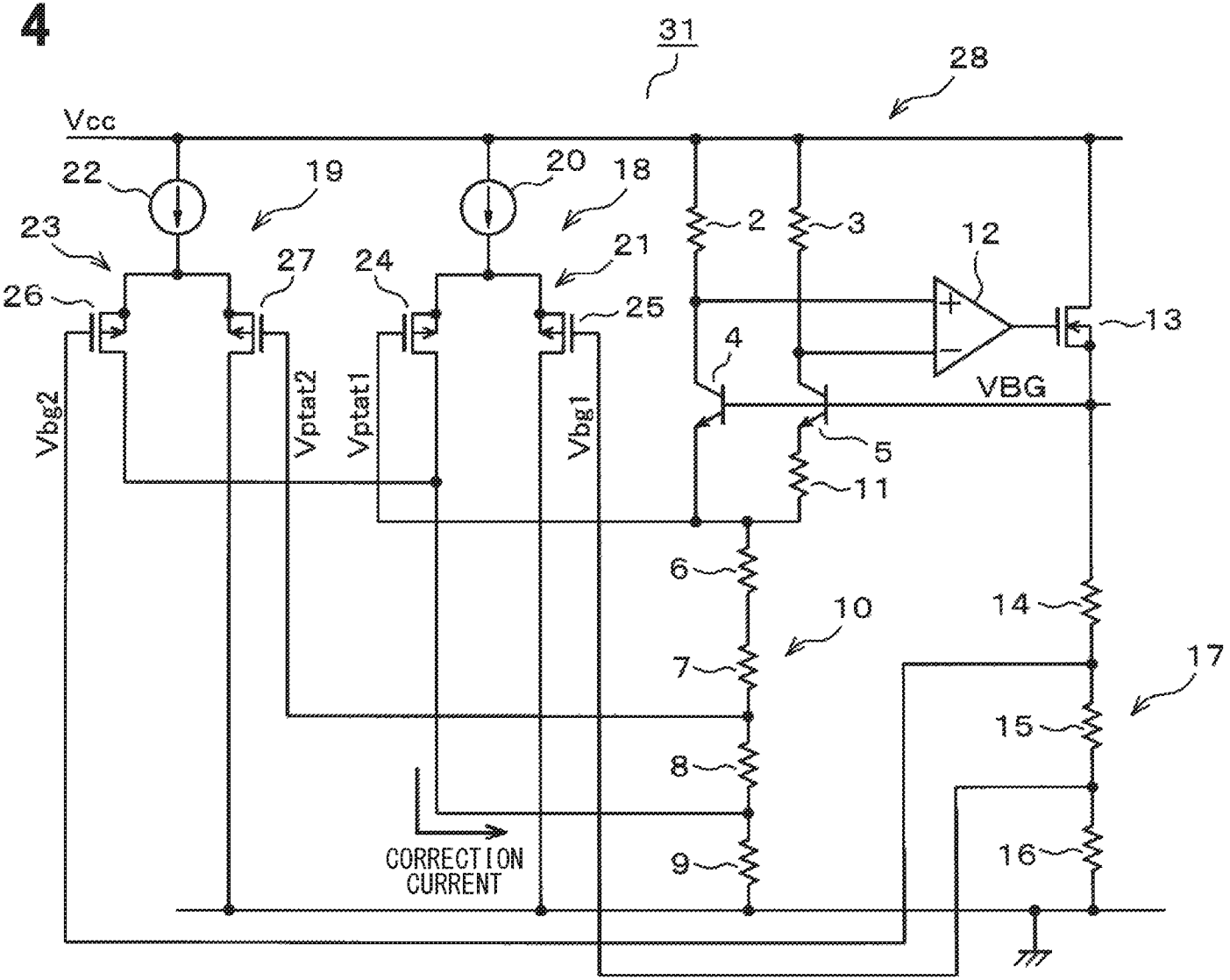
FIG. 4 is a circuit diagram showing a configuration of a reference voltage circuit according to a second embodiment.

As shown in FIG. 4, in a reference voltage circuit 31 according to a second embodiment, the gate of the FET 24 is connected to the high-side end of the second voltage dividing circuit 10, that is, the emitter of the transistor 4. The other configurations are the same as those of the first embodiment.

Third Embodiment

Figure 5:
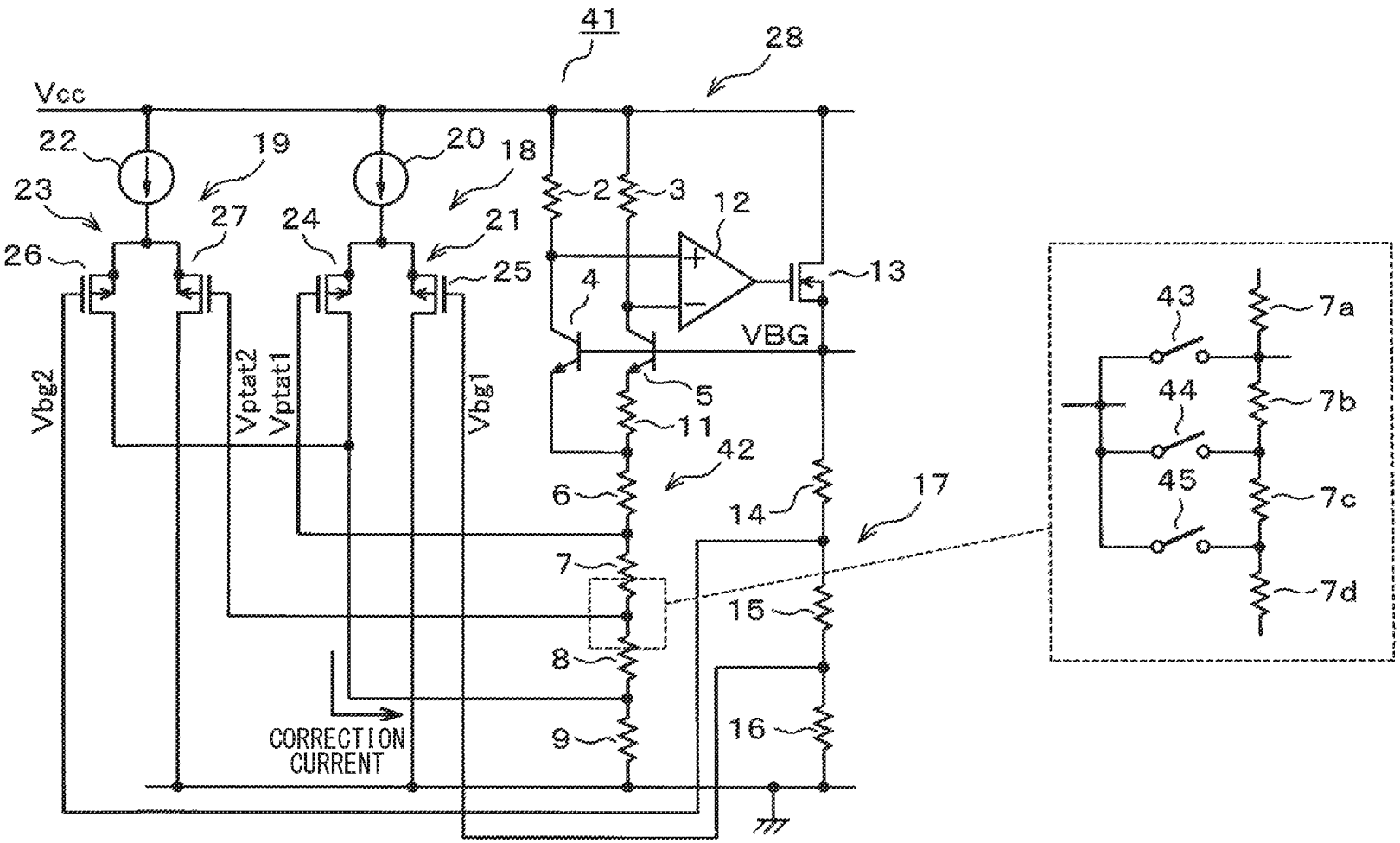
FIG. 5 is a circuit diagram showing a configuration of a reference voltage circuit according to a third embodiment.

As shown in FIG. 5, a reference voltage circuit 41 according to a third embodiment includes a series resistance circuit 42 instead of the second voltage dividing circuit 10. In the series resistance circuit 42, a portion corresponding to the resistance element 7 is formed of a series circuit of resistance elements 7*a* to 7*d* for a node to which the gate of the FET 27 is connected. Further, switches 43, 44 and 45 having one ends commonly connected are inserted between the gate of the FET 27 and common connection points of the resistance elements 7*a* and 7*b*, the resistance elements 7*b* and 7*c*, and the resistance elements 7*c* and 7*d*.

These switches 43, 44, 45 are, for example, analog switches. These switches 43 to 45 are turned on and off selectively by setting a voltage applied to a gate of an FET forming each switch to a binary level of high and low. This is in a tap-type trimming resistor configuration. The node to which the gate of the FET 24 is connected has the same configuration.

As described above, according to the third embodiment, the series resistance circuit 42 is configured by the tap-type trimming resistor, so that the temperature characteristic can be easily corrected. Similarly, the first voltage dividing circuit 17 may also be configured by using a tap-type trimming resistor.

Fourth Embodiment

Figure 6:
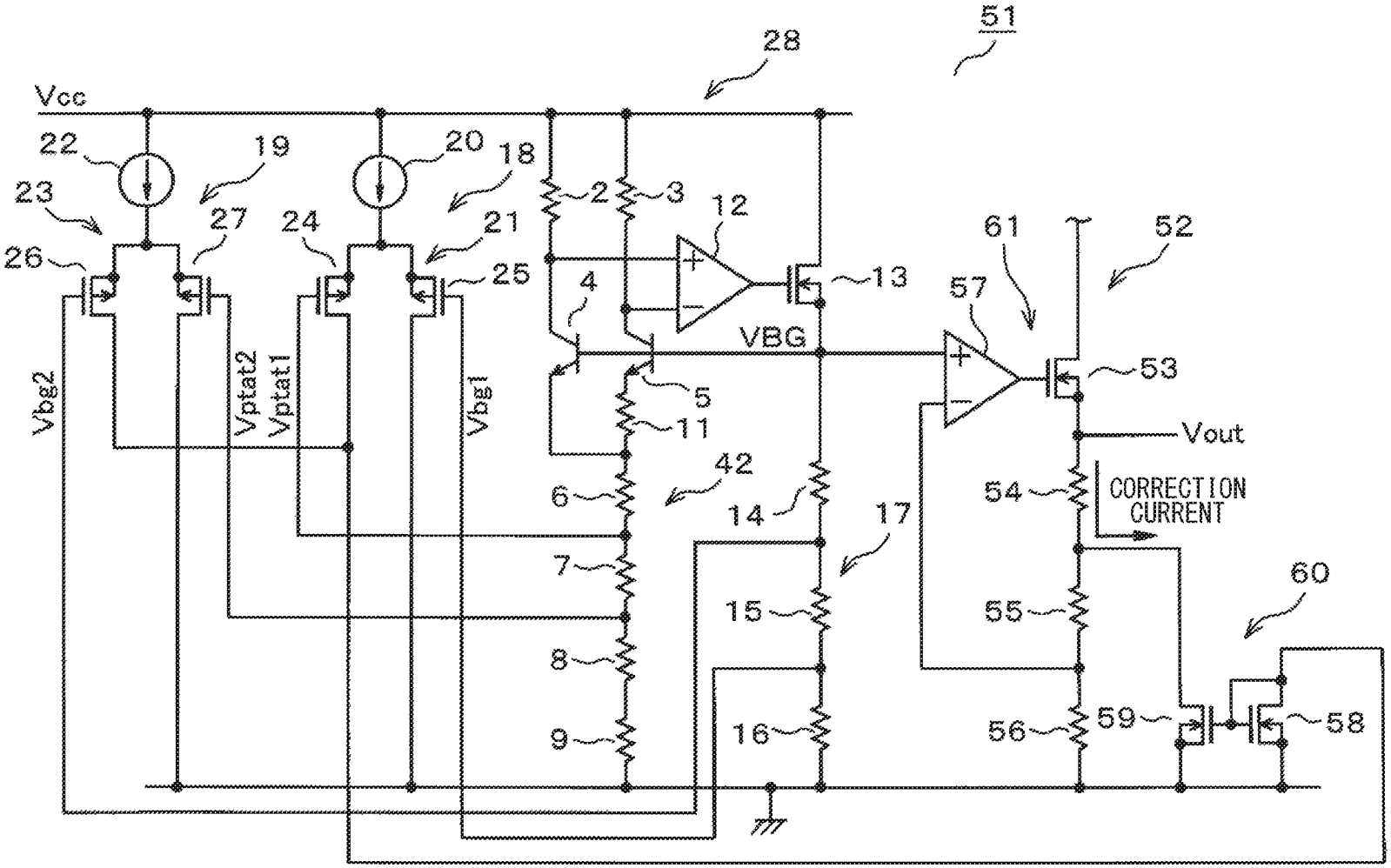
FIG. 6 is a circuit diagram showing a configuration of a reference voltage circuit according to a fourth embodiment.

As shown in FIG. 6, a reference voltage circuit 51 according to a fourth embodiment has a configuration in which a regulator 52 is arranged at an output stage of the reference voltage circuit 1 of the first embodiment. A series circuit of an N-channel MOSFET 53 and resistance elements 54 to 56 is connected between the power supply Vcc and the ground. A non-inverting input terminal of an operational amplifier 57 is connected to the source of the FET 13, and an inverting input terminal is connected to a common connection point of resistance elements 55 and 56.

The drains of the FETs 24 and 26 are connected to a drain of an N-channel MOSFET 58 instead of the common connection point of the resistance elements 8 and 9. The FET 58 forms a current mirror circuit 60 together with an N-channel MOSFET 59, and sources of the FETs 58 and 59 are connected to the ground. Gates of the FETs 58 and 59 are commonly connected to a drain of the FET 58, and a drain of the FET 59 is connected to a common connection point of the resistance elements 54 and 55. A series circuit of the operational amplifier 57, the FET 53 and the resistance elements 54 to 56 forms a differential amplifier circuit 61.

An operation of the fourth embodiment will be described. The regulator 52 outputs a voltage Vout produced by amplifying the output voltage VBG of the bandgap reference voltage circuit 28 from the source of the FET 53. A current corresponding to the temperature characteristic of the output voltage Vout of the regulator 52 flows through the series circuit of the resistance elements 54 to 56. A current mirror circuit 60 mirrors a correction current output from the drains of the FETs 24 and 26 and draws it out from the common connection point of the resistance elements 54 and 55. As a result, the temperature characteristic of the output voltage of the regulator 52 is corrected. Here, the drains of the FETs 24 and 26 that are commonly connected correspond to a current output terminal of the correction current output circuit.

As described above, according to the fourth embodiment, the reference voltage circuit 51 includes the regulator 52 that amplifies the output voltage VBG of the bandgap reference voltage circuit 28 and the current mirror circuit 60 that mirrors the current output from the drains of the FETs 24 and 26. The regulator 52 has the differential amplifier 61 and the resistance elements 54 to 56 connected in series between the output terminal of the differential amplifier 61 and the ground.

The reference voltage VBG output from the bandgap reference voltage circuit 28 is applied to a non-inverting input terminal of the operational amplifier 57 forming the differential amplifier 61. A non-inverting input terminal of the operational amplifier 57 is connected to the common connection point of the resistance elements 55 and 56. The drain of the FET 59, which is a path through which the current mirror circuit 60 passes the mirror current, is connected to the common connection point of the resistance elements 54 and 55. With this configuration, the temperature characteristic of the output voltage Vout can be corrected even in the configuration including the regulator 52 that amplifies the reference voltage VBG.

Fifth Embodiment

Figure 7:
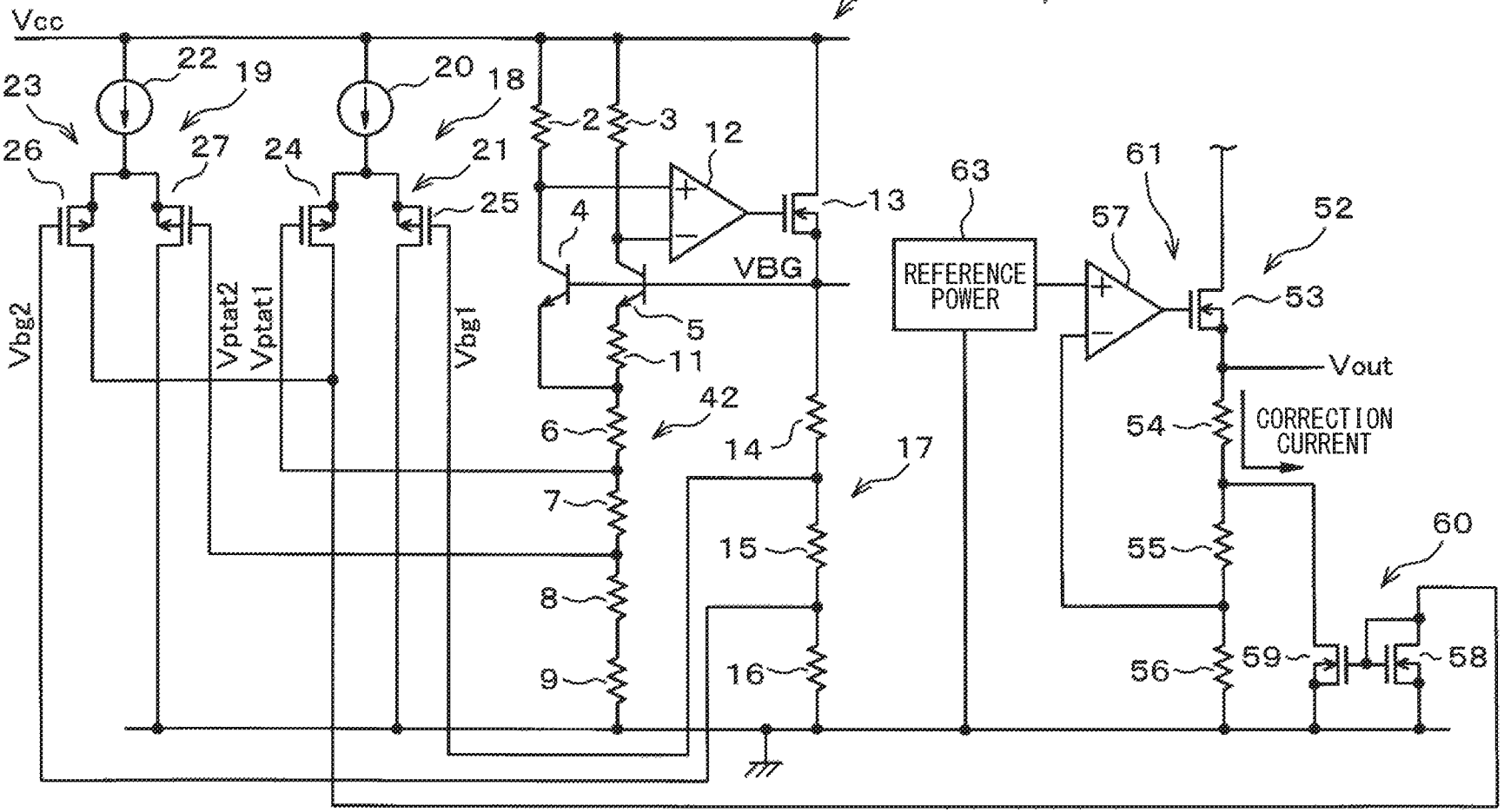
FIG. 7 is a circuit diagram showing a configuration of a reference voltage circuit according to a fifth embodiment.

A reference voltage circuit 62 according to a fifth embodiment shown in FIG. 7 differs from that of the fourth embodiment in that the regulator 52 amplifies a reference voltage output from a reference power supply 63 that is provided independently, instead of the reference voltage VBG. In this case, components corresponding to the reference voltage circuit 1 form a correction current output circuit 64.

Sixth Embodiment

Figure 8:
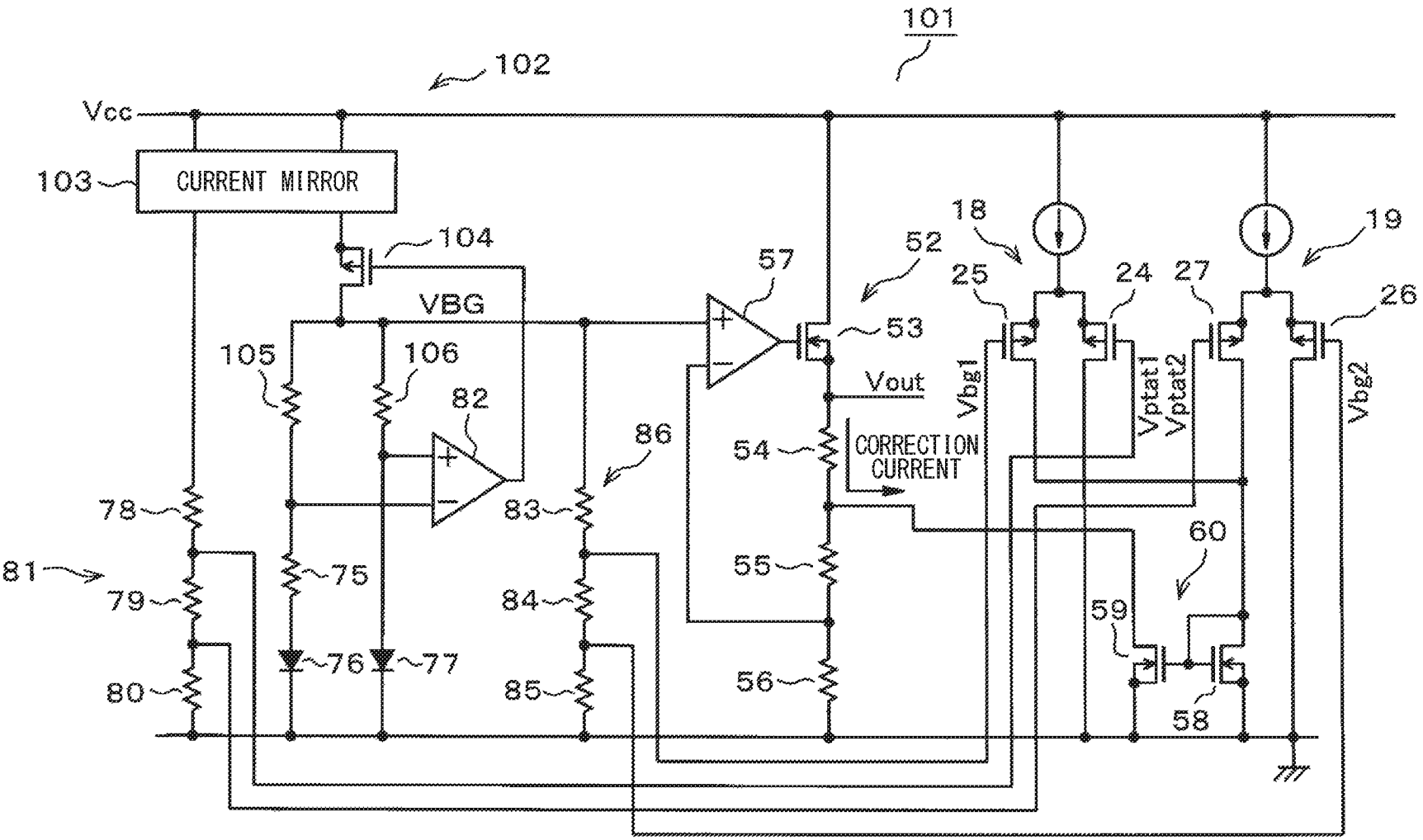
FIG. 8 is a circuit diagram showing a configuration of a reference voltage circuit according to a sixth embodiment.

A reference voltage circuit 101 according to a sixth embodiment shown in FIG. 8 includes a bandgap reference voltage circuit 102 having a different configuration. A current mirror circuit 103 forming the bandgap reference voltage circuit 102 has a power supply side terminal directly connected to the power supply Vcc, and has a main power supply path and one mirror current path. A P-channel MOSFET 104 is inserted in the main power supply path. A drain of the FET 104 is connected to high-side ends of resistance elements 105 and 106.

Low-side ends of the resistance elements 105 and 106 are connected to an inverting input terminal and a non-inverting input terminal of an operational amplifier 82, respectively. An output terminal of the operational amplifier 82 is connected to a gate of the FET 104. A mirror current path of the current mirror circuit 103 is connected to the ground via a second voltage dividing circuit 81 including resistance elements 78 to 80.

A high-side end of a resistance element 75 is connected to the inverting input terminal of the operational amplifier 82, and an anode of a diode 77 is connected to the non-inverting input terminal of the operational amplifier 82. The operational amplifier 82 outputs a voltage corresponding to a difference between a potential of the main current path of the current mirror circuit 103 and a potential of the mirror current path to the gate of the FET 104. As a result, the reference voltage VBG corresponding to the bandgap reference voltage is output to the drain of the FET 104.

The reference voltage VBG is amplified by the regulator 52 of the fourth embodiment and output as the voltage Vout. A first voltage dividing circuit 86 including resistance elements 83 to 85 is connected between the drain of the FET 104 and the ground. The gate of the FET 25 forming the first correction circuit 18 is connected to a common connection point of the resistance elements 83 and 84. The gate of the FET 26 forming the second correction circuit 19 is connected to a common connection point of the resistance elements 84 and 85. The gate of the FET 24 is connected to a common connection point of the resistance elements 78 and 79. The gate of the FET 27 is connected to a common connection point of the resistance elements 79 and 80.

According to the sixth embodiment configured as described above, the reference voltage circuit 101 includes the first voltage divider circuit 86 that generates the voltage produced by dividing the output voltage of the bandgap reference voltage circuit 102 in multiple stages, the current mirror circuit 103 and the operational amplifier 82. The non-inverting input terminal and the inverting input terminal of the operational amplifier 82 are respectively connected to the paths formed by shunting the main current path of the current mirror circuit 103 through the FET 104 and the resistance elements 105 and 106, and the output terminal is connected to the gate of the FET 104.

The second voltage dividing circuit 81 is connected between the mirror current path of the current mirror circuit 103 and the ground. The gates of the FETs 25 and 26 are connected to the respective nodes of the first voltage dividing circuit 86. The gates of the FETs 26 and 24 are connected to the respective nodes of the second voltage dividing circuit 81. Therefore, even in the configuration in which the regulator 52 amplifies the reference voltage VBG output from the bandgap reference voltage circuit 102, the temperature characteristic of the output voltage Vout can be corrected.

Seventh Embodiment

Figure 9:
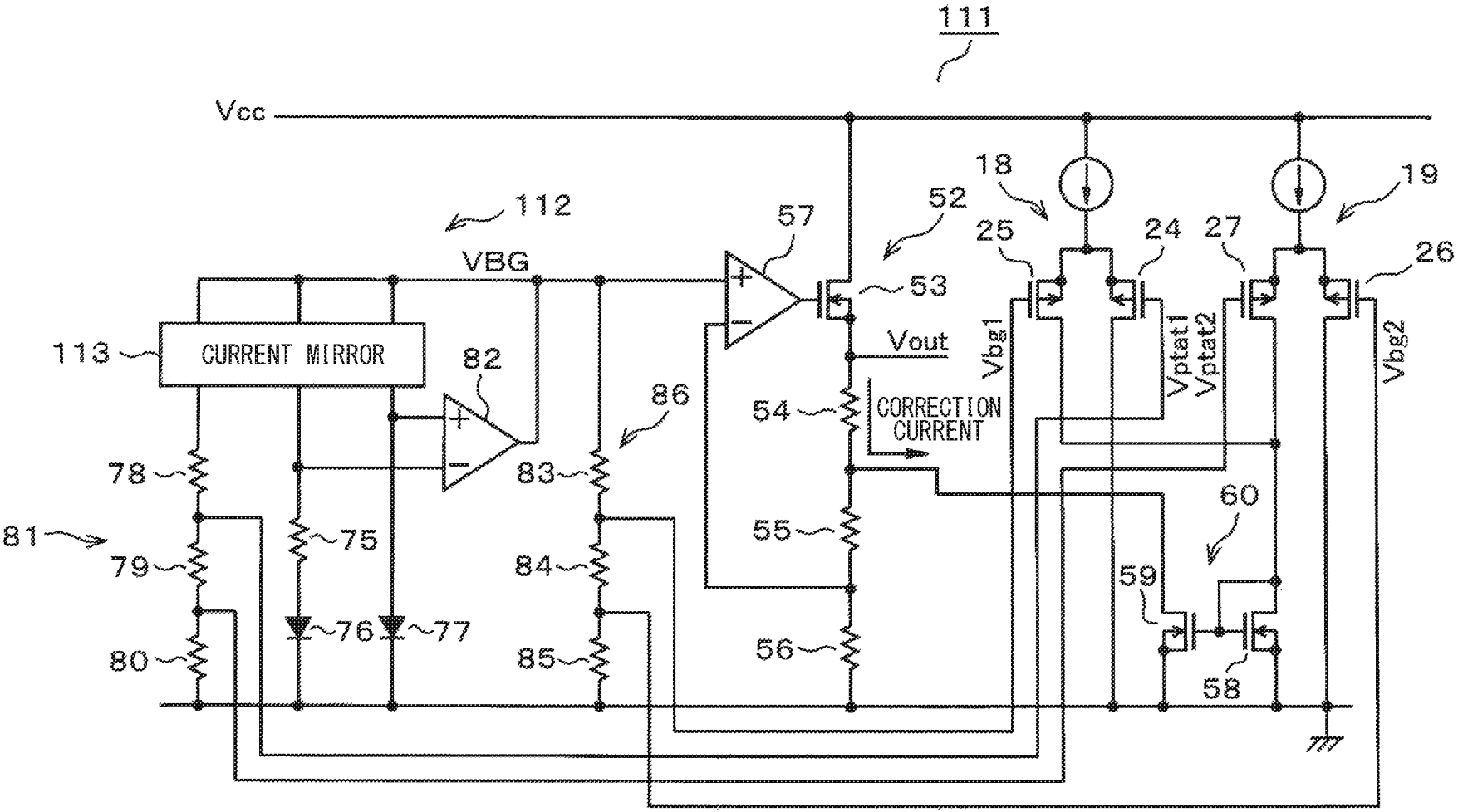
FIG. 9 is a circuit diagram showing a configuration of a reference voltage circuit according to a seventh embodiment.

A reference voltage circuit 111 according to a seventh embodiment shown in FIG. 9 is configured by replacing the bandgap reference voltage circuit 102 of the sixth embodiment with a bandgap reference voltage circuit 112. The bandgap reference voltage circuit 112 includes a current mirror circuit 113. The current mirror circuit 113 has a main current path and two mirror current paths.

The main current path of the current mirror circuit 113 is connected to the ground via the series circuit of the resistance element 75 and the forward-biased diode 76. One of the mirror current paths is connected to the ground via a forward-biased diode 77. The other one of the mirror current paths is connected to the ground via the second voltage dividing circuit 81. The inverting input terminal and the non-inverting input terminal of the operational amplifier 82 are connected to the high-side end of the resistance element 75 and an anode of the diode 77, respectively, as in the sixth embodiment. The output terminal of the operational amplifier 82 is connected to a power supply side terminal of the current mirror circuit 113. In this case, the potential of the power supply side terminal is the reference voltage VBG, According to the seventh embodiment configured as described above, the same effects as those of the sixth embodiment can be provided.

Eighth Embodiment

Figure 10:
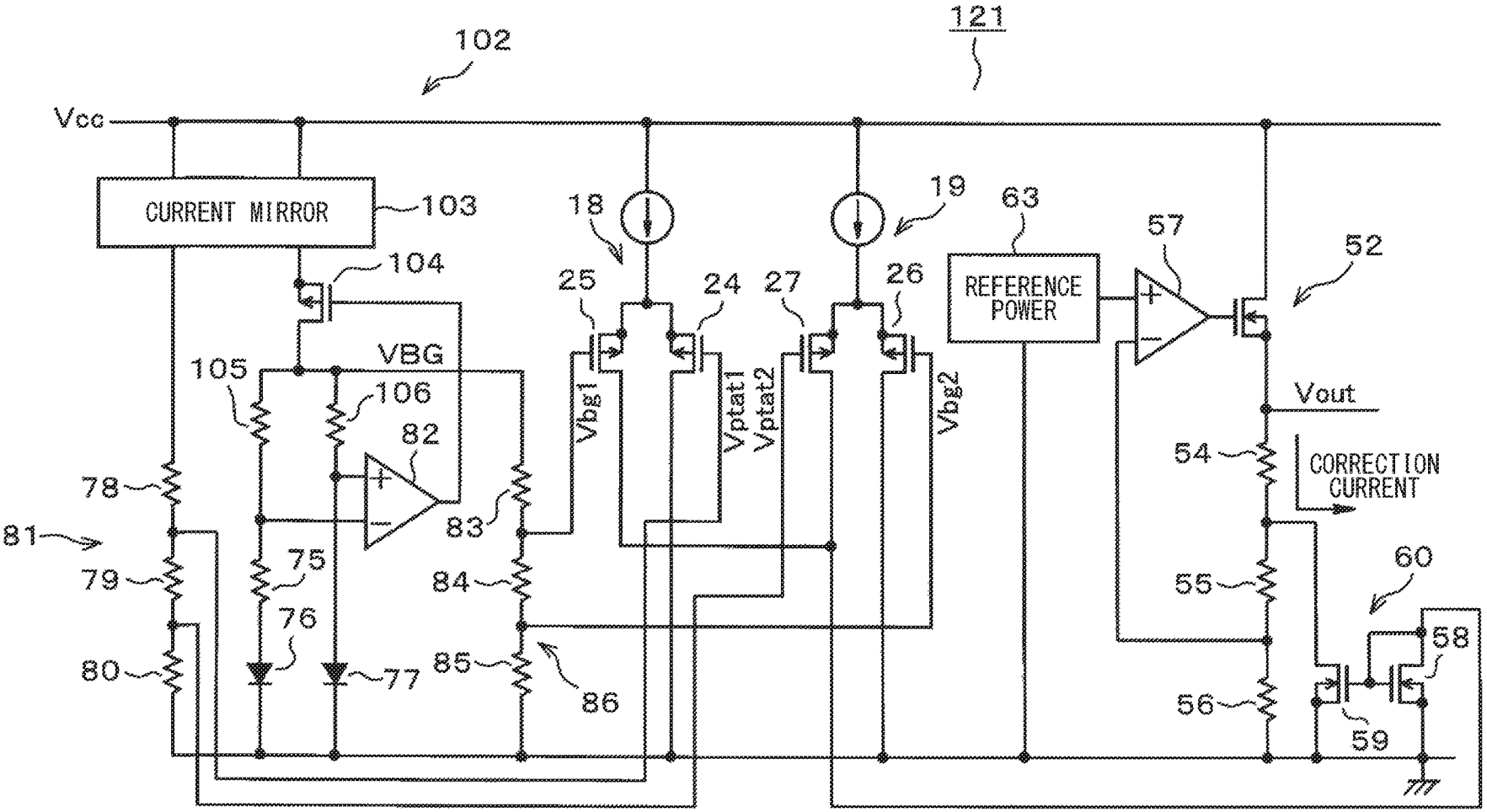
FIG. 10 is a circuit diagram showing a configuration of a reference voltage circuit according to an eighth embodiment.

A reference voltage circuit 121 according to an eighth embodiment shown in FIG. 10 is a modification of the sixth embodiment. The reference voltage generated by the reference power supply 63 is applied to the non-inverting input terminal of the operational amplifier 57 that forms the regulator 52, instead of the bandgap reference voltage, as in the fifth embodiment. According to the eighth embodiment configured as described above, with respect to the configuration, the temperature characteristic of the output voltage Vout can be corrected for the correction current supplied from the bandgap reference voltage circuit 102.

Ninth Embodiment

Figure 11:
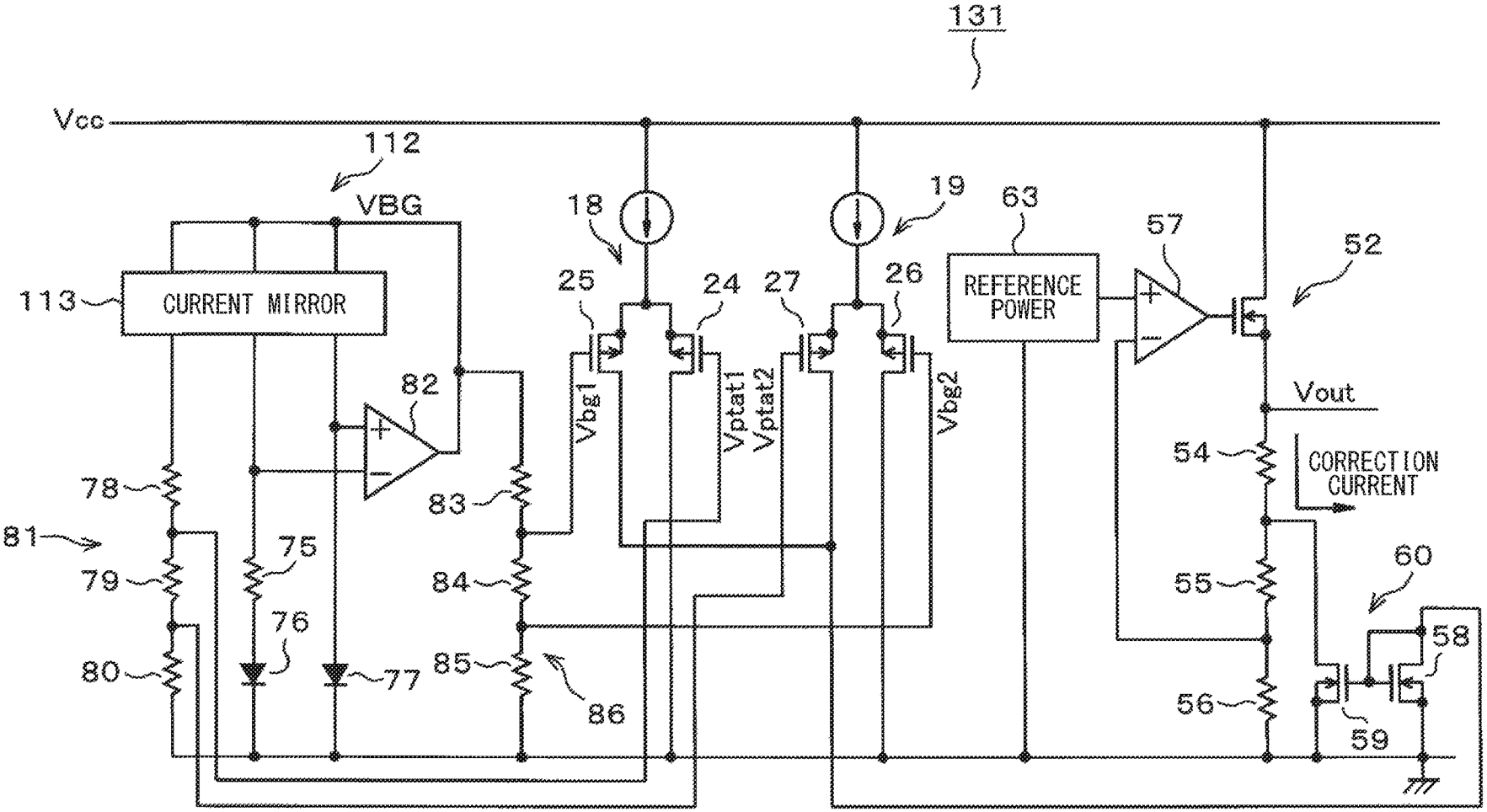
FIG. 11 is a circuit diagram showing a configuration of a reference voltage circuit according to a ninth embodiment.

A reference voltage circuit 131 according to a ninth embodiment shown in FIG. 11 is a combination of the bandgap reference voltage circuit 112 of the seventh embodiment and the regulator 52 that amplifies the reference voltage output from the reference power supply 63 of the fifth embodiment.

Other Embodiment

The first voltage dividing circuit may be formed of a resistance element capable of laser trimming.

The number of resistance elements forming the voltage dividing circuit may be two, four or more.

The differential pair may be formed of bipolar transistors.

A bipolar transistor may be used instead of the FET 13.

The configuration of the third embodiment may be applied to the fourth to eleventh embodiments.

Although the present disclosure has been made in accordance with the first to ninth embodiments, it is understood that the present disclosure is not limited to such embodiments and configurations. The present disclosure covers various modification examples and equivalent arrangements. In addition, various combinations and forms, and further, other combinations and forms including only one element, or more or less than these elements are also within the scope and the scope of the present disclosure.

What is claimed is:

1. A correction current output circuit comprising:

a bandgap reference voltage circuit;

a first voltage dividing circuit for generating divided voltages by dividing an output voltage of the bandgap reference voltage circuit in multiple stages;

a first correction circuit connected between a power supply and a ground and formed of a series circuit of a first current source and a first differential pair;

a second correction circuit connected between the power supply and the ground and formed of a series circuit of a second current source and a second differential pair; and a second voltage dividing circuit provided in a path, which generates a positive temperature characteristic voltage having a positive temperature characteristic, for dividing the positive temperature characteristic voltage in multiple stages; wherein a control terminal of a first transistor forming the first differential pair is connected to any node in the first voltage dividing circuit, a control terminal of a first transistor forming the second differential pair is connected to a node having a potential different from that of the node of the first voltage dividing circuit;

a control terminal of a second transistor forming the second differential pair is connected to a node indicating an arbitrary potential in the path for generating the positive temperature characteristic voltage, a control terminal of a second transistor forming the first differential pair is connected to a node having a potential different from that of the node of the path of the positive temperature characteristic voltage, a current output terminal of the second transistor forming the first differential pair and a current output terminal of the first transistor forming the second differential pair are connected to a common connection point from which a current correcting a temperature characteristic of a reference voltage generation circuit is generated.

2. The correction current output circuit according to claim 1, wherein:

at least one of the first voltage dividing circuit and the second voltage dividing circuit is formed of a resistance element capable of trimming.

3. The correction current output circuit according to claim 2, wherein:

at least one of the first voltage dividing circuit and the second voltage dividing circuit is configured to be capable of trimming by switching on and off of a plurality of switches.

4. A reference voltage circuit having a correction function comprising:

the correction current output circuit according to claim 1, wherein the current output terminals connected to the common connection point are connected, in the path of the positive temperature characteristic voltage, to a node of a potential different from the node connected to the control terminal of the second transistor forming the first differential pair and the node connected to the control terminal of the second transistor of the second differential pair.

5. A reference voltage circuit having a correction function comprising:

the correction current output circuit according to claim 1;

a reference voltage circuit;

a regulator for amplifying an output voltage of the reference voltage circuit; and a current mirror circuit for mirroring a current output from a current output terminal of the correction current output circuit, wherein the regulator includes a differential amplifier and first to third resistance elements connected in series between an output terminal of the differential amplifier and the ground, the differential amplifier has one terminal to which a reference voltage output from the reference voltage circuit is applied and an other terminal connected to a common connection point of the second and third resistance elements, and a path for a mirror current in the current mirror circuit is connected to the common connection point of the first and second resistance elements.

6. A correction current output circuit comprising:

a current mirror circuit having at least one mirror current path for mirroring a current flowing at a supply point of a bandgap reference voltage;

a first voltage dividing circuit formed of at least three resistance elements connected between one of mirror current paths and a ground;

a second voltage dividing circuit for dividing the bandgap reference voltage into divided voltages in multiple stages;

a first correction circuit connected between a power supply and the ground and formed of a series circuit of a first current source and a first differential pair;

a second correction circuit connected between the power supply and the ground and formed of a series circuit of a second current source and a second differential pair; and a control terminal of a first transistor forming the first differential pair and control terminal of a first transistor forming the second differential pair are connected to different nodes in a voltage path including a supply point of the bandgap reference voltage;

a control terminal of a second transistor forming the first differential pair is connected to a node indicating an arbitrary potential in the first voltage dividing circuit, and a control terminal of a second transistor forming the second differential pair is connected to a node having a potential different from that of the node of the first voltage dividing circuit, wherein a current output terminal of the first transistor forming the first differential pair and a current output terminal of the second transistor forming the second differential pair are connected to a common connection point from which a current for correcting a temperature characteristic of the reference voltage generation circuit is output.

7. The correction current output circuit according to claim 6, wherein:

the first voltage dividing circuit and the second voltage dividing circuit are formed of resistance elements capable of trimming, respectively.

8. The correction current output circuit according to claim 7, wherein:

the first voltage dividing circuit and the second voltage dividing circuit include a plurality of switches which are selectively turned on and off to trim the resistance elements, respectively.

9. The correction current output circuit according to claim 6, wherein:

the current mirror circuit includes a power side terminal directly connected to a power supply, a main current path and a mirror current path, a transistor is connected between the current mirror circuit and the supply point of the bandgap reference voltage in the main current path; and a bandgap reference voltage circuit including an operational amplifier is provided, the operational amplifier having two input terminals connected to two current paths, which divide a current flowing through the transistor, and an output terminal connected to a control terminal of the transistor; and the first voltage dividing circuit is connected to the ground in the mirror current path of the current mirror circuit.

10. The correction current output circuit according to claim 6, wherein:

the current mirror circuit has a power side terminal connected to a supply point of the bandgap reference voltage and a main current path and two mirror current paths;

a bandgap reference voltage circuit including an operational amplifier is provided, the operational amplifier having two input terminals connected to the main current path and one of the mirror current paths, respectively, and an output terminal connected to the supply point of the bandgap reference voltage; and the first voltage dividing circuit is connected to the ground in a remaining mirror current path of the current mirror circuit.

11. A reference voltage circuit having a correction function comprising:

the correction current output circuit according to claim 6;

a regulator for amplifying a reference voltage; and a current mirror circuit for mirroring a current output from a current output terminal of the correction current output circuit, wherein the regulator includes a differential amplifier, and first to third resistance elements connected in series between an output terminal of the differential amplifier and a ground, a reference voltage is applied to one input terminal of the differential amplifier and an other input terminal of the differential amplifier is connected to a common connection point of the second and third resistance elements, and a path for a mirror current in the current mirror circuit is connected to the common connection point of the first and second resistance elements.

12. The reference voltage circuit having a correction function according to claim 11, wherein:

the reference voltage is the bandgap reference voltage.

13. The reference voltage circuit having a correction function according to claim 11, further comprising:

a reference voltage circuit, the reference voltage is output from the reference voltage circuit.

* * * * *